US006039843A

United States Patent [19]

Wight

[11] Patent Number: 6,039,843

[45] Date of Patent: Mar. 21, 2000

[54] LOADED CLAMPED FOIL BLADE FOR USE IN A WEB-FORMING SECTION OF A PAPERMAKING MACHINE

[75] Inventor: E. William Wight, Roscoe, Ill.

[73] Assignee: Beloit Technologies, Inc., Wilmington, Del.

[21] Appl. No.: 09/081,622

[22] Filed: May 19, 1998

[51] Int. Cl.[7] ..... D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| 3,027,940 | 4/1962 | Dunlap | 162/352 |
| 3,576,716 | 4/1971 | Reynolds et al. | 162/352 |
| 3,647,620 | 3/1972 | Truxa | 162/352 |
| 4,088,531 | 5/1978 | Lamminen | 162/352 |
| 4,420,370 | 12/1983 | Saad . | |
| 4,559,105 | 12/1985 | Sennett et al. . | |
| 4,865,692 | 9/1989 | Kade et al. . | |
| 5,169,500 | 12/1992 | Mejdell . | |
| 5,262,009 | 11/1993 | Schiel et al. . | |
| 5,262,010 | 11/1993 | Bubik et al. . | |
| 5,437,769 | 8/1995 | Bando et al. . | |

*Primary Examiner*—Karen M. Hastings

[57] ABSTRACT

A foil blade for use in dewatering devices found in a web forming section of a papermaking machine is described. The improved foil blade according to the present invention is easily installed into and removed from such dewatering devices. The improved foil blade of the present invention is rigidly mounted within the same dewatering devices such that the foil blade does not rotate or change geometry during a papermaking process as a wire or fabric having a stock mixture thereon travels over the foil blade. The improvement resides in providing a loaded clamping assembly for the foil blade. In one embodiment, according to the present invention, the loaded clamping assembly comprises a pneumatic load air tube to rigidly secure the foil blade to a dewatering device in a web-forming section of a papermaking machine. The foil blade being firmly clamped in position by way of the loaded air tube, cannot rotate or change geometry during operation. The loaded clamping assembly further includes a pneumatic unload air tube to unclamp the foil blade from the dewatering device allowing the foil blade to be easily slipped in and out in the cross-machine direction of the papermaking machine. In another embodiment of the present invention, the load air tube is replaced with a spring loaded clamp. In yet another embodiment of the present invention, the load air tube is replaced with a cam operated load mechanism. The loaded clamping assemblies can be arranged in pivoting clamp styles or a sliding clamp style as will be further described herein.

13 Claims, 8 Drawing Sheets

LOADED CLAMPED FOIL BLADE FOR USE IN A WEB-FORMING SECTION OF A PAPERMAKING MACHINE

BACKGROUND OF THE INVENTION

1. Field of the Ivention

The present invention relates to a foil blade for use in a web-forming section of a papermaking machine, and relates more particularly to a foil blade for use in forming shoes, forming boxes, forming boards, foil boxes, vacuum foil boxes, suction foil boxes or, generally, dewatering devices used in a web-forming section of a papermaking machine. Specifically, the present invention relates to an improved foil blade that is easily installed into and removed from the aforementioned devices and; once mounted, the foil blade of the present invention does not rotate or change geometry during operation thereby preventing improper blade angles and geometry between the foil blade and a wire or fabric traveling thereover which, if present, cause operating problems and excessive wire or fabric wear.

2. Description of the Prior Art

In a papermaking machine, a traveling forming wire or fabric receives paper stock consisting of a mixture of water and pulp, typically referred to as a slurry of pulp, from a slice lip or slice area of a headbox. Once the stock mixture impinges and is received by the forming wire or fabric, the stock mixture travels along a web-forming section of the papermaking machine. As the stock mixture continues down the web-forming section, the stock mixture is transformed into a moving web of paper. Upon leaving the web-forming section, the web of paper undergoes further processing in a press section, a dryer section and finishing sections until a final paper product is produced.

Paper stock or slurry coming out of a headbox, depending on the type of paper being produced, typically has a consistency in the range of 0.05–1.5%. At the end of a web-forming section of a papermaking machine, depending on the type of paper being produced, a formed web of paper typically has a consistency of 10–30% as the web enters a press section of the papermaking machine.

A web-forming section of a papermaking machine can be of many different designs, depending on the type of paper being produced. Typical web-forming sections are referred to as Fourdriniers, twin wire formers, gap formers, or a combination of these. In order to transform a slurry of pulp having a consistency of 0.05–1.5% as the slurry leaves a headbox to a formed web having a consistency of 10–30% as the web leaves a web-forming section, a significant amount of water must be removed from the stock mixture between a headbox and a press section of a papermaking machine. Various dewatering devices are used in a web-forming section to remove water from the paper stock or pulp slurry being formed into a web. Such dewatering devices include forming shoes, forming boxes, forming boards, foil boxes, vacuum foil boxes, suction foil boxes, or the like, generally known to those skilled in the art.

Most of the dewatering devices used in a web-forming section of a papermaking machine include a foil blade. A function of such a foil blade is to enhance drainage of water from a pulp fiber-water mixture as the mixture or slurry travels between a headbox and a press section of a papermaking machine. Foil blades provide pressure impulses which affect the formation of a paper web as well as the drainage of water from a stock mixture. Foil blades can be located on both sides of a wire or forming fabric in certain formers. These formers drain water from both sides of a web. On Fourdrinier machines, foil blades are on the bottom side of the wire. As noted, foil blades are mounted to such dewatering devices as forming boards, foil boxes, forming shoes, and the like. These dewatering devices are essentially strength sections which may or may not be fitted with vacuum to assist in the drainage of water from the web being formed. Foil blades can be made from several different materials. Typically, foil blades are made of aluminum oxide, silicone nitride, and/or silicone carbide, which are generally referred to as "ceramics" by those skilled in the art. Poly is also sometimes used as a material of construction for a foil blade. A typical construction of a continuous ceramic foil blade has ceramic segments bonded into a pultruded fiberglass material. The base of the foil blade being the reinforced fiberglass and the top being the ceramic. There are also segmented, ceramic foil blades made as one continuous single ceramic piece, top and bottom, but in segments across the machine width. It is the top of the foil blade that is in contact with a forming wire or fabric. The base of the foil blade must be fastened to a dewatering device or a strength section. This is usually done by either a T-bar or dove-tail clamp design, as will be more fully explained below. The advantage of the T-bar design is quick and easy removal and installation of a continuous foil blade. The disadvantage of the T-bar design is a foil blade used with this design has a tendency to rotate during operation due to the mounting clearances required in order to slide a foil blade onto its mating T-bar mounting structure. The advantage of the dove-tail design is a solid clamp foil blade that does not rotate during operation. The disadvantage of the dove-tail design is the time and effort required to remove and install a foil blade.

A foil blade has an upper surface of soft or hardened material which is accurately positioned to form a divergent angle in the machine direction with a wire or fabric traveling over the foil blade so as to cause an area of reduced pressure between the wire or fabric and the upper surface of the foil blade to effectuate dewatering of a paper stock mixture or slurry through the wire or fabric. It is imperative in the relationship between a foil blade and a wire or fabric that a uniform positional relationship be maintained with respect to the divergent angle of the upper surface of the foil blade relative to the wire or fabric, as will be more further explained directly below.

Foil blades wear with operation of a papermaking machine and a typical arrangement permits removal of a foil blade and replacement with a reworked or fresh blade. One such arrangement provides a T-bar support device attached to a dewatering device. The T-bar support device supports a foil blade. The foil blade contains an appropriate slot which allows the foil blade to be attached to the T-bar support. The sliding relationship between the slot of a foil blade and the T-bar of a T-bar support permits removal and installation of the foil blade in a cross-machine direction. Typically, tolerances between a conventional foil blade and a mounting T-bar support are in the area of 0.008 inches to 0.020 inches loose. The loose fit tolerances between a foil blade and a T-bar support allows the foil blade to rock or rotate on the T-bar support mounting as a wire or fabric travels over the foil blade during a papermaking process, thereby changing the geometry of the angle between the upper surface of a foil blade and the wire or fabric traveling over the foil blade. A change in geometry between a foil blade and the wire or fabric traveling thereover, contributes to sheet defects, non-uniform drainage, light spots, rewet, or dirt and fiber build up on the blade with resultant possible worming or streaking of the paper sheet being produced. Additionally, an improperly positioned foil blade with respect to a wire or fabric traversing over a foil blade adversely affects the optimum pressure differential needed in order to drain water from the stock mixture to form a properly formed web in a web-forming section of a papermaking machine. A rotating foil blade of the T-bar design is also problematic because the degree of rotation adversely affects the activity and the amount of pressure pulsations transmitted to the stock. Too much activity can result in stock jump which, if excessive, can cause formation defects. Not enough activity can also result in non-uniform drainage which produces streaks and other problems known to those skilled in the art. Unfortunately, if tolerances are reduced between a foil blade and a T-bar mounting support so as to reduce the amount of rocking or rotation of the foil blade during operation, it becomes extremely difficult, if not impossible, for a paper maker to install and/or remove a foil blade.

Another arrangement which permits removal of a foil blade and replacement with a reworked or fresh blade includes a dove-tail bar support device attached to a dewatering device which supports a foil blade. In this conventional arrangement, a foil blade is provided with a dove-tail such that one end of the dove-tail bar support device receives the dove-tail end of the foil blade. The other ends of the foil blade and the dove-tail bar support are clamped together by means of screws or the like. Generally, the dove-tail arrangement rigidly fixes a foil blade in position which prevents the angle between the upper surface of the foil blade and the wire or fabric traveling thereover from changing. However, a significant drawback to the dove-tail design is that a foil blade cannot be easily removed or installed without removing the wire or fabric of the entire web-forming section. The wire or fabric must be removed in order to allow access to the screws or clamping means attaching the foil blade to the dewatering device. Generally, there is not enough space to allow access to the screws with the wire or fabric in position. Those skilled in the art will appreciate the amount of work and excessive downtime of a papermaking machine, and the cost associated therewith, that are incurred in having to remove a wire or fabric in a web-forming section of a papermaking machine in order to replace old or damaged foil blades with new foil blades.

What is needed is a foil blade which eliminates the heretofore mentioned problems. What is needed is a foil blade which is easily installed and removed from dewatering devices in a web-forming section of a papermaking machine. Additionally, what is further needed is a foil blade which is rigidly mounted to a dewatering device. Such a foil blade must be able to withstand the forces being applied against it so that the foil blade does not rock or rotate during operation resulting in a change in geometry between the blade and a wire or fabric traveling over the blade. Additionally, what is needed is a foil blade that reduces operating problems and excessive wire wear during operation.

SUMMARY OF THE INVENTION

The solution to providing a foil blade that is easily installed and removed from a dewatering device found in a web-forming section of a papermaking machine and is capable of being rigidly mounted within the same dewatering device so that the foil blade does not rock or rotate during a papermaking process as a wire or fabric having a stock mixture thereon travels thereover, resides in providing a loaded clamping assembly for the foil blade. In one embodiment according to the present invention, the loaded clamping assembly comprises a pneumatic load air tube to rigidly secure the foil blade to a dewatering device in a web-forming section of a papermaking machine. The foil blade being firmly clamped in position by way of the loaded air tube, cannot rotate or change geometry during operation. The loaded clamping assembly further includes a pneumatic unload air tube to unclamp the foil blade from the dewatering device allowing the foil blade to be easily slipped in and out in the cross-machine direction of the papermaking machine. In another embodiment of the present invention, the load air tube is replaced with a spring loaded clamp. In yet another embodiment of the present invention, the load air tube is replaced with a cam operated load mechanism. The loaded clamping assemblies can be arranged in pivoting clamp styles or a sliding clamp style as will be further described in the Description of the Preferred Embodiments herein.

Accordingly, it is a feature of the present invention to provide a foil blade that is easily installed into and removed from a dewatering device found in a web-forming section of a papermaking machine.

A further feature of the present invention is to provide a foil blade that, in addition to being easily installed and removed, is rigidly attached to a dewatering device found in a web-forming section of a papermaking machine such that the foil blade does not rotate or change geometry as a forming wire or fabric transporting a paper stock mix from one end of the web-forming section to another traverses thereover.

Another feature of the present invention is to provide an improved foil blade that has an upper surface which is accurately positioned to form a divergent angle in the machine direction with a forming wire or fabric traveling over the foil blade so as to cause an area of reduced pressure between the wire or fabric and the upper surface of the foil blade to effectuate dewatering of a paper stock or slurry through the wire or fabric. The improved foil blade being designed and arranged such that the optimum geometry between the foil blade and the wire or fabric traveling thereover does not change during operation thereby reducing sheet rewet, dirt and fiber buildup on the blade or adverse affects in the reduced pressure needed in order to drain water from the stock mixture, all of which results in a better final paper product.

Yet another feature of the present invention is to provide a foil blade according to the above-mentioned features which will reduce operating problems typically found with prior art foil blades in the production of paper.

Still another feature of the present invention is to reduce excessive forming wire or forming fabric wear found in prior art arrangements when foil blades are improperly positioned due to rotation in relation to the forming wire or fabric traveling thereover.

A still further feature of the present invention is to be able to remove and install a foil blade with a minimum amount of downtime to the normally continuous process of making paper in a papermaking machine.

These and other objects, features and advantages of the invention will become apparent to those skilled in the art upon reading the description of the preferred embodiments, in conjunction with the attached drawings.

DESCRIPTION OF THE PREFERRED EMBODIMENT

Foil blades utilizing loaded clamping assemblies according to the present invention are shown in FIGS. 6–10. The foil blades of the present invention are designed for use in dewatering devices found in web-forming sections of papermaking machines such as those illustrated in FIGS. 1–3.

Figure 1:
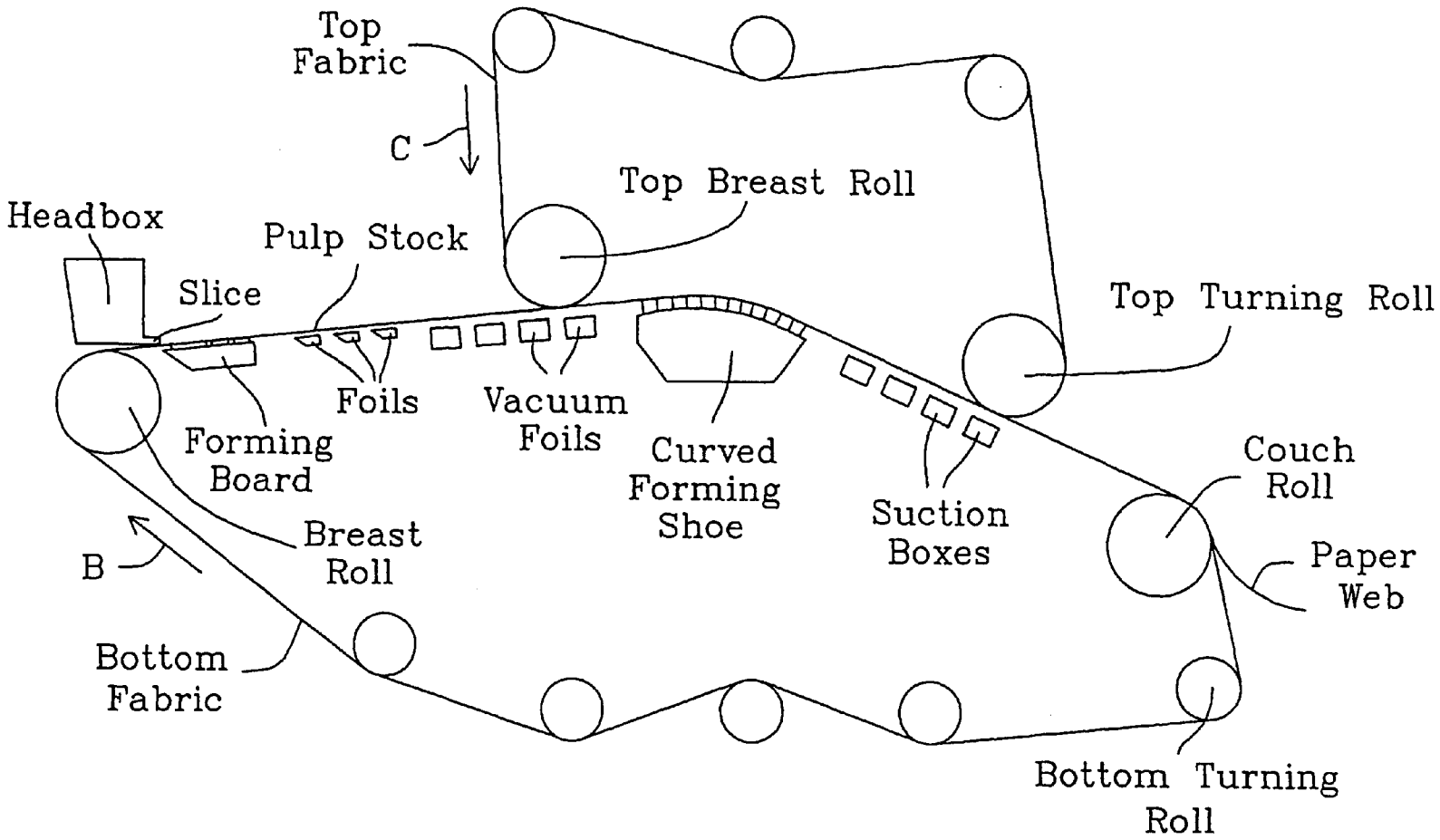
PRIOR ART Fig. 1
FIG. 1 is a simplified schematic side view of a web-forming section of a paper machine, the web-forming section being a twin wire former containing various dewatering devices in which foil blades according to the present invention can be used.

FIG. 1 is a schematic side view of a twin wire paper former in which the essential components are indicated. In this type of former, which is shown as an example of a web-forming section of a papermaking machine, a bottom wire or fabric runs in the direction shown by arrow B over a breast roll, under a slice in a headbox and over and in contact with a forming board, foils, vacuum foils, a curved forming shoe, suction boxes, then around a couch roll, turning roll, various returning, guide and tensioning rolls and back to the breast roll. A top wire or fabric runs in the direction shown by arrow C over a top breast roll and converges with the bottom fabric, in advance of the curved forming shoe, then follows the bottom fabric to a top turning roll from where it is returned over guide and tensioning rolls to the top breast roll. A pulp stock mixture issuing from the slice is deposited on the bottom fabric just ahead of the forming board and is partially dewatered by the forming board, foils and vacuum foils before entering the nip between the converging top fabric. As the fabrics are entwined, under some tension, around the curved surface of the curved forming shoe, the outer, top fabric is pressed towards the inner, bottom fabric which bears against the shoe and more water is squeezed out of the pulp sandwiched between the fabrics thus forming a paper web. The paper web is removed from the bottom fabric after it passes over the couch roll and moves on to the next process in the papermaking process.

Figure 2:
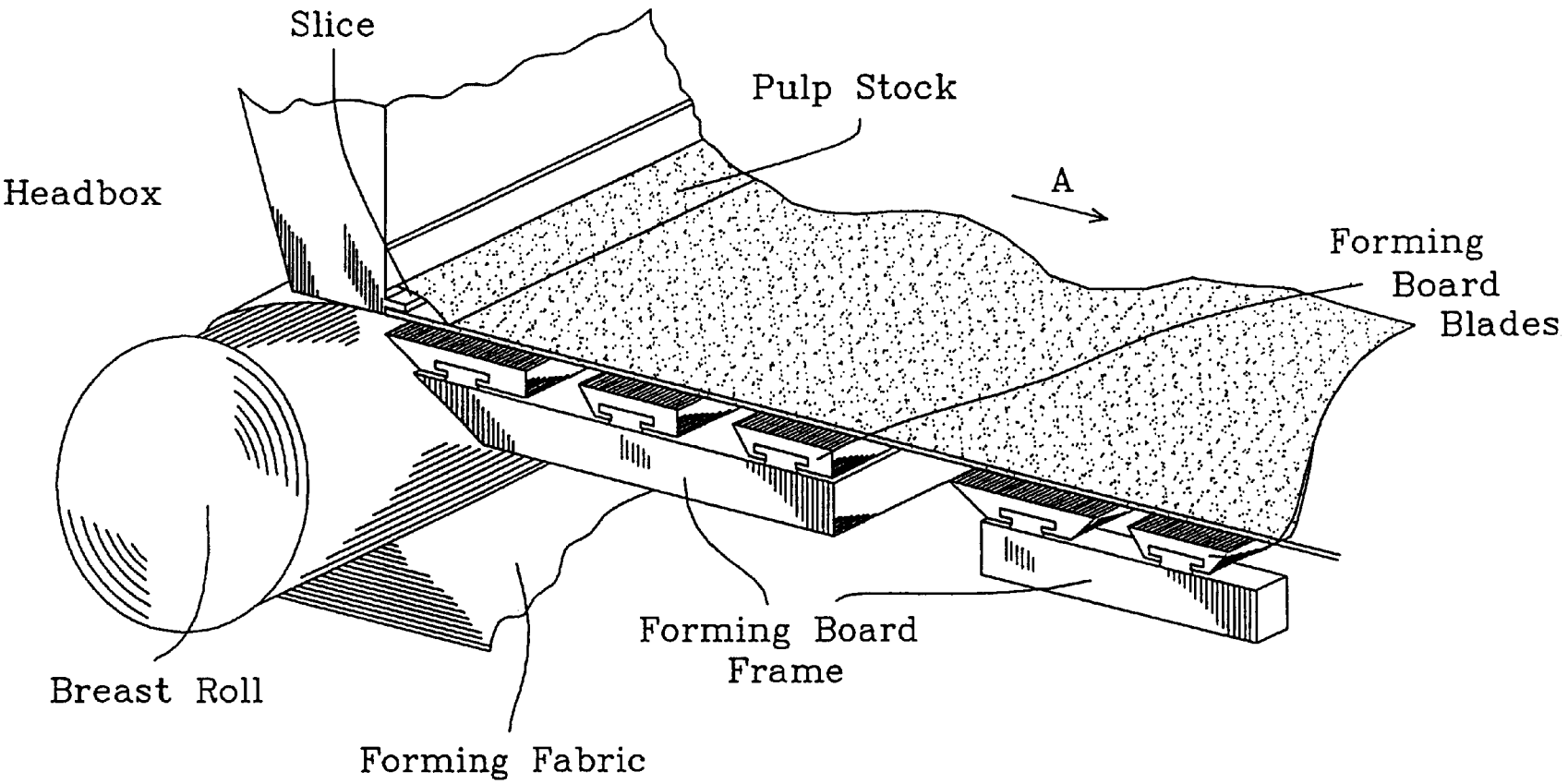
PRIOR ART Fig. 2
FIG. 2 is a perspective view of another typical web-forming section of a paper machine, the web-forming section being a Fourdrinier papermaking machine showing a forming board utilizing prior art foil blades, the foil blades according to the present invention are capable of replacing the depicted prior art foil blades.

FIG. 2 is a perspective view of another typical web-forming section of a papermaking machine in which the essential components are indicated. In this type of former, which is generally known as a Fourdrinier papermaking machine, a breast roll is shown over which a Fourdrinier forming fabric passes in the direction shown by arrow A. A jet of wet pulp stock is discharged from a slice of a headbox onto the fabric. A forming board frame is shown supporting forming board blades, which extend the width of the machine and are detachably mounted on T-shaped or T-bar rails. As the pulp stock mixture moves with the forming fabric over the forming board blades down the web-forming section of the papermaking machine, water drains from the pulp stock mixture through the forming fabric into the spaces between the forming board blades as a result of the reduced pressure areas between the blades and fabric and the pressure pulsations provided by the blades as previously described in the Background section herein.

In the types of papermaking machines shown in FIGS. 1 and 2, loaded clamped foil blades according to the present invention may be placed in any of the dewatering devices therein, namely, forming boards, foils, curved forming shoes, vacuum foils, suction boxes, or any other dewatering devices described in the Background section hereof, generally found in web forming sections of papermaking machines.

Figure 3:
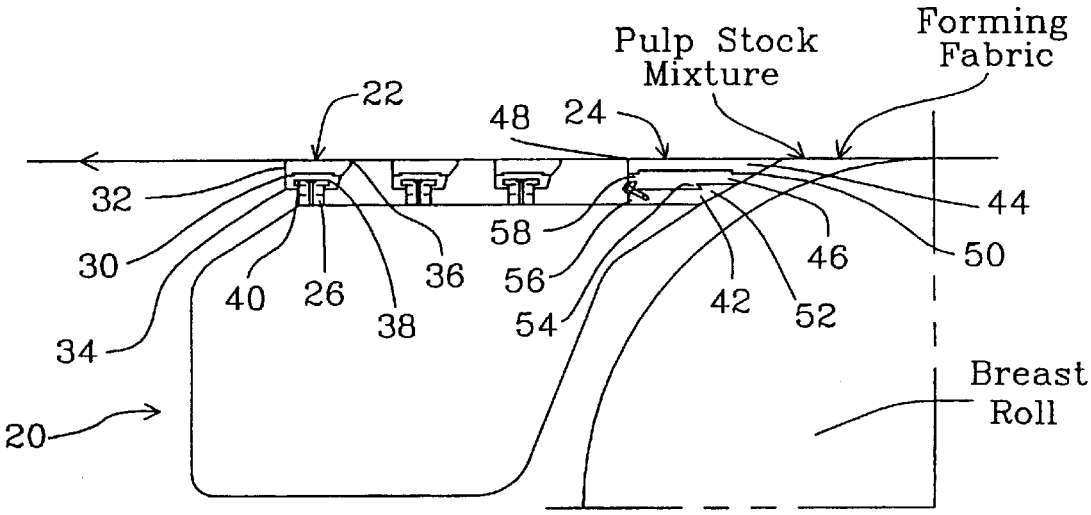
Fig. 3 PRIOR ART
FIG. 3 is a perspective side view of a forming board utilizing a prior art T-bar foil design and a prior art dove-tail foil design.

FIG. 3 is a perspective side view of a forming board utilizing the prior art T-bar foil design and the prior art dove-tail foil design previously mentioned.

A forming fabric contains a pulp stock mixture thereon and travels from a breast roll to the forming board (20). The forming board (20) has both a T-bar foil design (22) and a dove-tail foil design (24). In general, the type of foil design used depends on the type of dewatering device being utilized and where the dewatering device is located in a web-forming section of a papermaking machine. Those skilled in the art know when the T-bar foil design or the dove-tail foil design is appropriate.

The T-bar foil design (22) consists of the following elements. A T-bar mounting structure (26) is attached to the dewatering device or forming board (20), as shown in FIG. 3, by means of screws as shown or by other means generally known to those skilled in the art. The T-bar mounting structure is generally constructed of a pultruded fiberglass material or stainless steel. A foil blade (30) is made up of two pieces. The top section (32) of the continuous foil blade (30) is made up of ceramic segments as previously described in the Background section. The ceramic segments are bonded into a pultruded fiberglass material. The base (34) of the foil blade (30) being the reinforced fiberglass material. It should be noted that although the foil blade is shown as having two sections, those skilled in the art will appreciate that the foil blade can be of a single continuous ceramic one-piece design in cross machine sections. The top surface (36) of the top section (32) of each foil blade (30) is in contact with the forming fabric traveling thereover. The angle between the top surface (36) of each foil blade (30) and the forming fabric, usually between 0 and 10 degrees and not visibly shown in FIG. 3, being such that the foil blades (30) help dewater the pulp mixture traveling thereover and in the formation of a paper web. The base (34) of each foil blade (30) is attached to its T-bar mounting structure (26). The base (34) contains a slot (38) running the entire length of the foil blade (30) which is designed to fit over the T-bar mounting structure (26). The T-bar mounting structure (26) has a top section (40) in the shape of a "T", hence the name T-bar mounting structure. The slot (38) of the base (34) of the foil blade (30) is shaped to cooperate with the top T-section (40) of the T-bar mounting structure (26) when the foil blade (30) is slid into position over the T-bar mounting structure (26).

Figure 4:
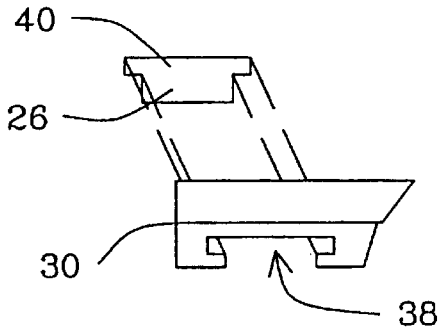
Fig. 4 PRIOR ART
FIG. 4 is an enlarged perspective view of the T-bar foil design shown in FIG. 3.

FIG. 4 shows an enlarged perspective view of the T-bar foil design of FIG. 3. The T-bar mounting structure (26) is fixedly attached to a dewatering device (20) as earlier described in reference to FIG. 3. The foil blade (30) is attached to the T-bar mounting structure (26) by sliding the slot (38) of the foil blade (30) over the T-shaped top section (40) of the T-bar mounting structure (26). In order for the foil blade (30) to be slid onto the T-bar mounting structure (26), tolerances in the area of 0.008 inches to 0.020 inches are provided between the mating surfaces of the foil blade (30) and the T-bar mounting structure (26).

In operation, as previously noted, a forming fabric or wire travels over the top surface (36) of the foil blades (30) found in dewatering sections of a web forming section of a papermaking machine. The loose fit tolerance between the foil blade (30) and the T-bar mounting structure (26) causes the foil blade (30) to rock or rotate during operation, resulting in all of the problems discussed in the Background section herein.

The dove-tail foil design (24), shown in FIG. 3, consists of the following elements. A mounting pad (42) is attached to the dewatering device or forming board (20). The mounting pad (42) can be made of steel, but usually is made of stainless steel. The pad (42) is usually welded to the dewatering device (20). Those skilled in the art will recognize that other conventional means are available to attach the pad (42) to the device (20). The top section (44) of the continuous foil blade (50) is made up of ceramic segments as previously described in the Background section. These ceramic sections are bonded into a pultruded fiberglass material. The base (46) of the foil blade (50) being the reinforced fiberglass material. It should be noted that as described for the foil blade with respect to the T-bar foil design that, although the foil blade is shown as having two sections, those skilled in the art will appreciate that the foil blade can be of a single continuous ceramic one-piece design in cross machine sections. The top surface (48) of the top section (44) of the foil blade (50) is in contact with the forming fabric traveling thereover. The angle between the top surface (48) of the foil blade (50) and the forming fabric, usually between 0 and 10 degrees and not visibly shown in FIG. 3, being such that the foil blade (50) helps dewater the pulp mixture traveling thereover and in the formation of a paper web. The base (46) of the foil blade (50) is attached to the mounting pad (42). The mounting pad (42) and the base (46) of the foil blade (50) contain mating dove-tail ends. The dove-tail end (52) of the mounting pad (42) receives one end (54) of the dove-tail base (46) of the foil blade (50). In this way, the foil blade (50) is semi-attached to the mounting pad (42). The other ends (56) and (58) of the mounting pad (42) and foil blade (50) respectively, are attached by means of screws, as shown, or the like to rigidly attach the foil blade (50) to the dewatering device (20).

Figure 5:
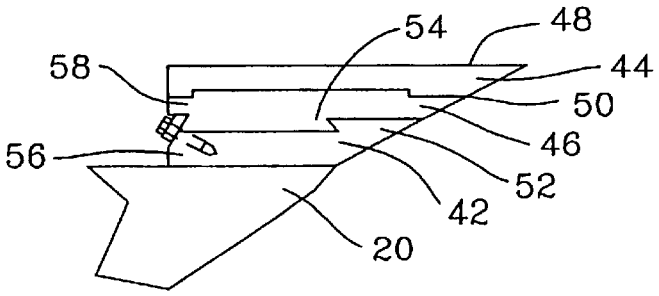
PRIOR ART Fig. 5
FIG. 5 is an enlarged perspective side view of the dove-tail foil design shown in FIG. 3.

FIG. 5 shows an enlarged perspective side view of the dove-tail foil design (24) shown in FIG. 3. The mounting pad (42) is fixedly attached to the dewatering device (20) as earlier described in reference to FIG. 3. The foil blade (50) is attached to the mounting pad (42) by mating one end (54) of the foil blade (50) with an end (52) of the mounting pad (42) and securing the other ends (56) and (58) together by various attachment means. In this design, unlike the T-bar foil design (22), a foil blade cannot be easily removed or installed without removing the wire or fabric of the entire web forming section. The wire or fabric must be removed in order to allow access to the screws or clamping means attaching the foil blade to the dewatering device. This, of course, creates all of the problems discussed in the Background section herein.

As can be seen, there are significant drawbacks to both of the prior art T-bar and dove-tail foil designs. The present invention concerns a new loaded clamping foil blade assembly to address the problems of the prior art foil blades.

Figure 6:
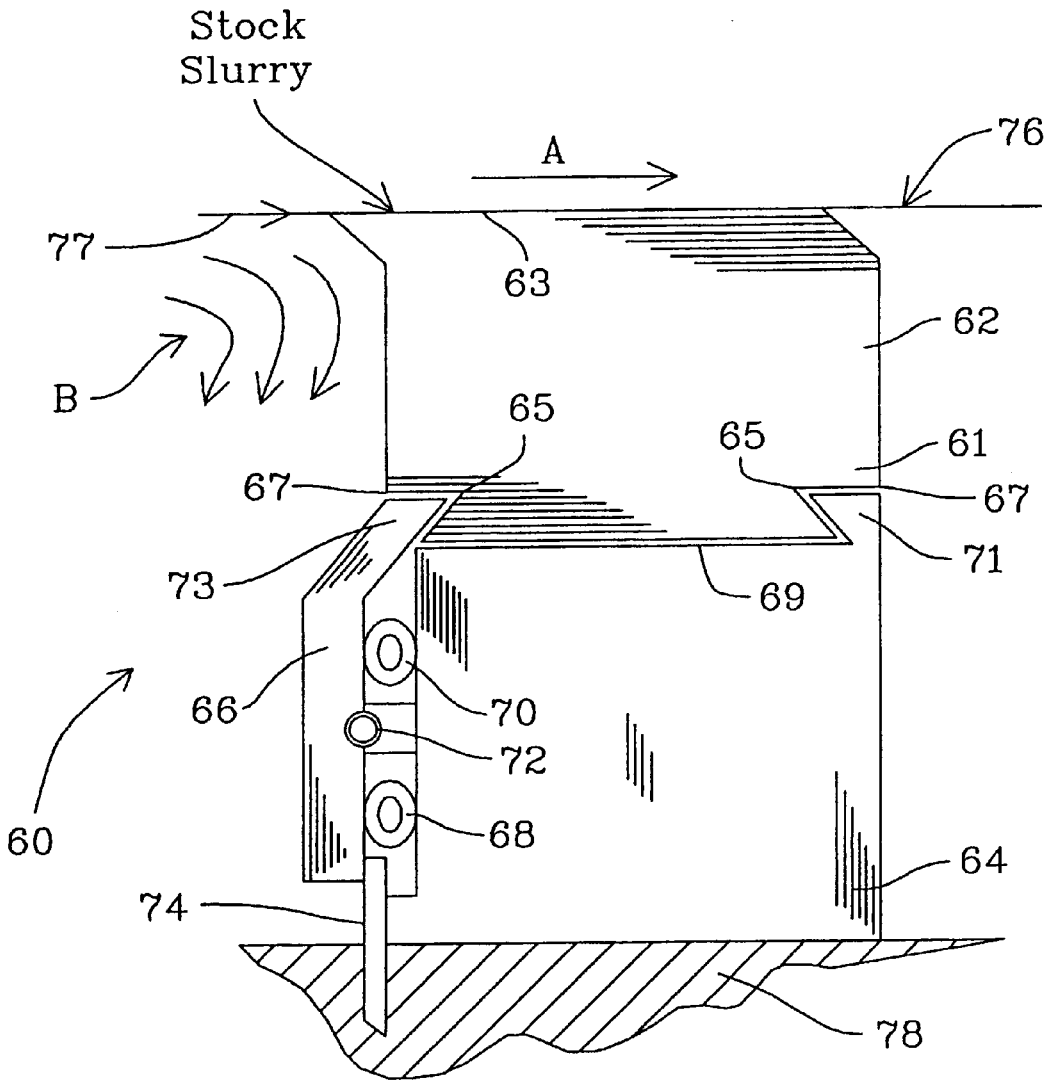
FIG. 6 is a perspective side view of a loaded clamping assembly according to the present invention referred to as a pivoting clamp style clamping assembly described herein and capable of being used in the dewatering devices of FIGS. 1–3.

FIG. 6 is a perspective side view of a loaded clamping assembly according to the present invention referred to as a pivoting clamp style clamping assembly. The loaded clamping assembly shown in FIG. 6 is capable of being used in any of the dewatering devices shown and described in FIGS. 1–3 or as mentioned previously herein.

The loaded clamping assembly (60) consists of a foil blade (62), a blade mounting pad (64), a clamping piece (66), a load clamp tube (68), an unclamp tube (70), a pivot (72) and a locking pin (74). As shown in FIG. 6, a forming wire or fabric (76) supporting a stock slurry travels over a top surface (63) of the foil blade (62). The foil blade (62) may be made up of ceramic segments and a fiberglass pultrusion or made of solid, continuous ceramic one-piece structures as previously described. In order to optimize dewatering and formation of the stock traveling over the blade (62), an appropriate relationship between the top surface (63) of the foil blade (62) and the bottom surface (77) of the forming wire or fabric (76) is provided. For ease of illustration in FIGS. 6–10, an angle is not shown between the wire (76) and blade (62). However, those skilled in the art will recognize that an angle is sometimes present in order to achieve optimal results. The foil blade (62) has a base (61) which contains dove-tail slots (65) on both ends (67). The blade mounting pad (64) is rigidly attached to a dewatering structure (78) according to conventional methods. The blade mounting pad (64) contains a top surface (69) which has a dove-tail protrusion (71) arranged for receiving one end (67) of the foil blade (62).

Found on the upstream side of the blade mounting pad (64) in the direction of travel (A) of the forming fabric (76) is an unclamp tube (70), a pivot (72) and a load clamp tube (68); cooperating with these is the clamping piece (66).

The pivoting clamp style loaded clamping assembly is assembled as follows. FIG. 6 shows the loaded clamping assembly (60) already assembled. For ease of illustration, a large gap between the foil blade and the blade mounting pad is shown. In actual operation, the blade and mounting pad fit snuggly together. As can be appreciated from the description concerning FIGS. 1–5, the blade mounting pad (64) extends in the cross-machine direction across the width of a papermaking machine and is conventionally attached to a dewatering device (78). The dove-tail protrusion (71) of the top surface (69) of the blade mounting pad (64) slidably cooperates with one dove-tail slot (65) of one end (67) of the base (61) of the foil blade (62). When sliding the foil blade (62) onto the blade mounting pad (64), the load clamp tube (68) is deflated and the unclamp tube (70) is inflated. It should be noted that the clamp and unclamp tubes described herein, are generally known to those skilled in the art. These tubes are usually air tubes, and they are connected to a pressurized air supply (not shown). In assembling the loaded clamping assembly (60) of FIG. 6, when the pneumatic unclamp tube (70) is inflated and the pneumatic clamp tube (68) is deflated, the unclamp tube (70) forces the clamping piece (66) away from the blade mounting pad (64). The clamping piece (66) pivots around the pivot (72) depending on which tube is loaded and which tube is unloaded.

Once the foil blade (62) is positioned on the blade mounting pad (64), and the respective dove-tail ends (67) and (71) are connected, the clamping piece (66) is pivoted into position by inflating the load clamp tube (68) and deflating the unclamp tube (70). The clamping piece (66) has a top surface (73) of a shape which cooperates with the other dove-tail end (67) of the base (61) of the blade (62).

Once the foil blade (62) is rigidly attached to the blade mounting pad (64) by way of the load clamp tube (68), a locking pin (74) is set into position, as shown in FIG. 6, to prevent the clamping piece (66) from becoming disengaged with the base (61) of the blade (62) should the load clamp tube (68) fail and air pressure is lost in the pneumatic load tube.

To summarize, the pivoting clamp style loaded clamping assembly of FIG. 6 operates as follows. One side of the dove-tail of the blade is held in the fixed mating dove-tail of the support structure. The other side of the dove-tail blade is captivated by the pivoting clamp. The pivoting clamp is activated by a pneumatic tube that provides the clamping force to secure the dove-tail end and, thus, the blade in place. A second pneumatic tube is used to unclamp the blade during a blade change operation. A locking device can prevent accidental unclamping of the dove-tail blade in the event of loss of air pressure in the pneumatic clamp tube.

In FIG. 6, the forming wire or fabric (76) is shown as traveling over the foil blade (62) in direction (A). In dewatering and forming the stock traveling over the blade in a web-forming section, the water being removed from the stock needs a place to go. In reviewing FIGS. 1–3, it can be seen that there is an area between each foil blade where removed water can travel. This area is generally devoid of any obstructions, so the water freely flows between the blades. If there is an obstruction, such as another piece of equipment, the water could bounce off of the obstruction and rewet the web by impinging the fabric beneath the web, thereby rendering the purpose of the blades useless or cause formation defects.

In FIG. 6, the clamping piece (66), pivot (72) and tubes (68) and (70) are shown as being located on the upstream side of the foil blade (62) and pad (64) in the direction of travel. The water removed from the stock mixture through the wire or fabric (76) exits the fabric and travels past the foil (62) and pad (64) into the dewatering device (78) as shown by arrows B. So that the water does not bounce back up into the fabric (76), the clamping piece (66) is of a streamlined design such that the flow of water past the blade (62) and pad (64) into the dewatering device (78) is uninterrupted. The downstream portion of the foil blade (62) and mounting pad (64), where the respective dove-tail ends (67) and (71) are connected, is shown as having a smooth vertical surface. If desirable, to ensure optimum dewatering flow, the clamping piece (66) and related equipment can be positioned on the downstream side of the blade (62) and pad (64) and the smooth vertical side with the dove-tail ends can be positioned on the upstream side. However, the preferred embodiment is to position the clamping piece (66) and related equipment on the upstream side for the following reasons.

Considering the forces applied to the blade (62) as a result of the direction of travel of the forming wire (76), and the geometry between the foil blade (62) and the wire (76), those skilled in the art will understand that the majority of the forces will be applied against the downstream connection between the blade (62) and pad (64). Locating the dove-tail ends (67) and (71) on the downstream side is a safety precaution. If the clamping load tube (68) fails and/or the locking pin (74) fails, the forces acting on the blade (62) will help ensure the blade (62) stays in position during operation via the dove-tail connections between the blade (62) and pad (64). The forces acting on the blade (62) in the direction of travel help lock the dove-tail connections between the blade (62) and pad (64) by forcing the pieces together. If the clamping load tube (68) and locking pin (74) are located on the downstream side and there is a failure, there is nothing to keep the blade (62) in position during operation. In such an arrangement, since the dove-tail ends would be located on the upstream side, the forces action on the blade (62) would push the blade (62) off of the pad (64) because the failed clamping arrangement on the downstream side would not be able to counter the forces being applied. If a blade (62) becomes detached from the mounting pad (64), it can cause extensive damage to a wire and/or forming equipment.

Thus, with a properly designed clamping piece (66) and related equipment, locating the clamping piece (66) and related equipment on the upstream side of the foil blade (62) and mounting pad (64) will allow adequate dewatering flow and at the same time provide a safety net should the loaded clamping assembly (60) fail, thereby preventing a detached foil blade (62) from becoming damaged and/or from damaging the fabric (76) and/or dewatering unit (78).

The loaded clamping assembly (60) of FIG. 6 not only provides for a foil blade that is easily installed into and removed from a dewatering device found in a web forming section of a papermaking machine by means of pneumatic load and unload tubes, the loaded clamping assembly (60) rigidly attaches the same foil blade to a dewatering device found in a web forming section of a papermaking machine such that the foil blade will not rotate or change geometry as a forming wire or fabric transporting a paper stock mix from one end of a web forming section to another traverses thereover.

Figure 7:
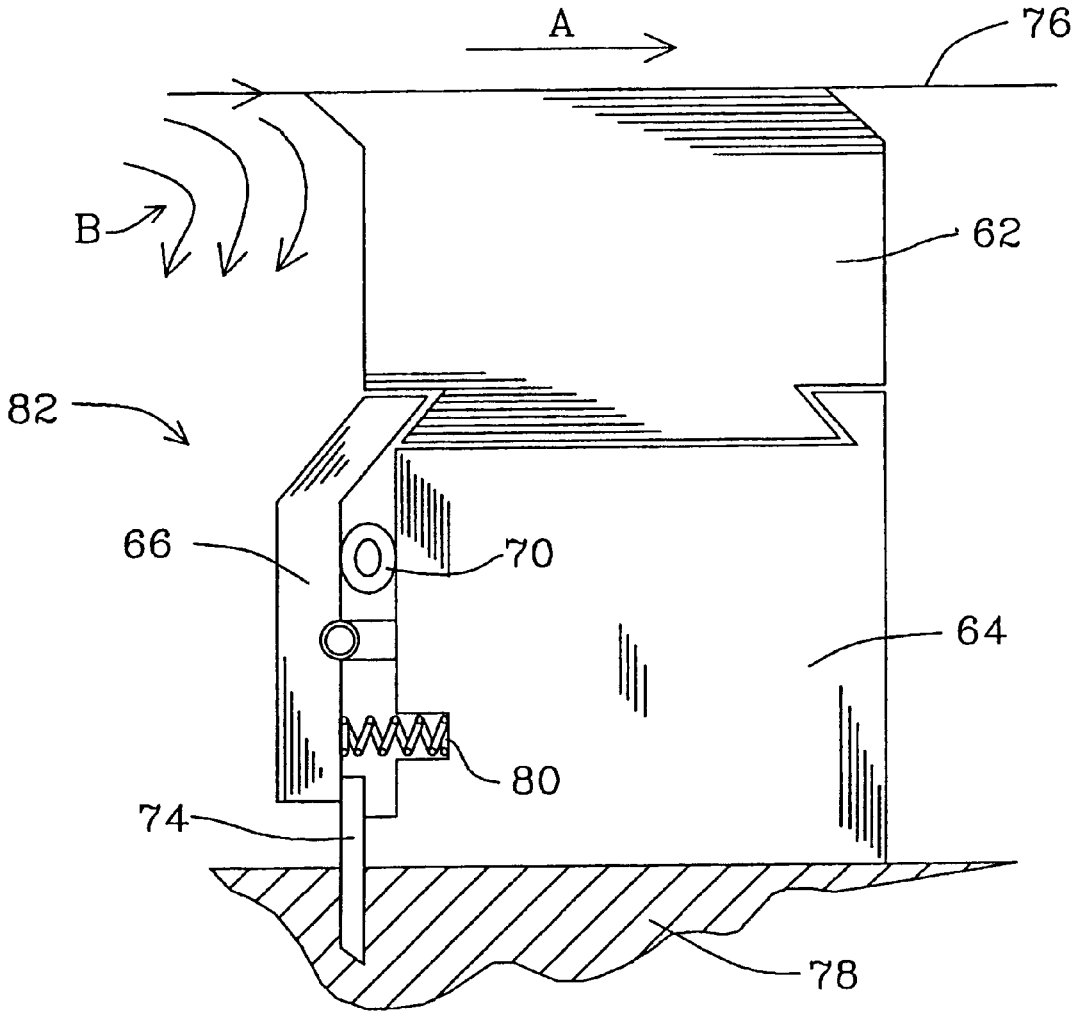
FIG. 7 is a perspective side view of another embodiment of a pivoting clamp style clamping assembly using a spring loaded clamp.

FIG. 7 is a perspective side view of another embodiment of a pivoting clamp style clamping assembly. In the loaded clamping assembly (82), the load clamp tube (68) is replaced with a spring loaded clamp (80).

If the unclamp tube (70) is inflated, the load clamp spring (80) is compressed and the foil blade (62) can be installed into or removed from the dewatering device (78) in the same manner as that described for FIG. 6. If the unload tube (70) is deflated, the load clamp spring (80) is extended and the foil blade (62) is locked into position on mounting pad (64) in the same manner as that described for FIG. 6. The locking pin (74) is used in the same manner as that described in FIG. 6 . The clamping piece (66) and related equipment are preferably arranged on the upstream side of the blade (62) and pad (64), and the dove-tail connections between the blade (62) and pad (64) are preferably located on the downstream side of the blade (62) and pad (64), for the same reasons described in reference to FIG. 6.

Thus, the loaded clamping assembly (82) of FIG. 7 also provides a foil blade that is easily installed into and removed from a dewatering device and, once mounted, the foil blade is rigidly attached to the dewatering device.

Figure 8:
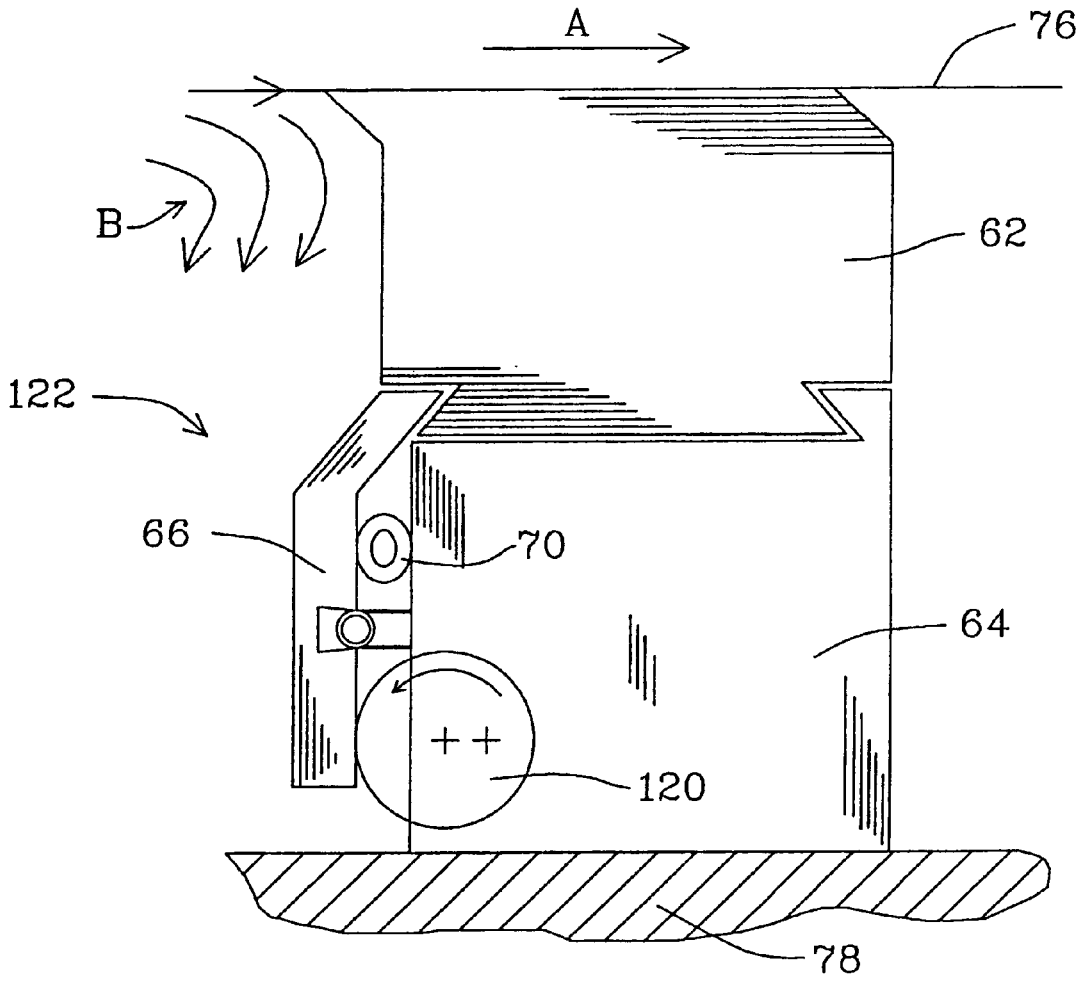
FIG. 8 is a perspective side view of another embodiment of a pivoting clamp style clamping assembly using a cam operated load mechanism.

FIG. 8 is a perspective side view of another embodiment of a pivoting clamp style clamping assembly. In the loaded clamping assembly (122), the load clamp tube (68) is replaced with a cam operated load mechanism (120). The cam operated load mechanism (120) can be of many different cam designs generally known to those skilled in the art.

If the unclamp tube (70) is inflated, the cam operated load mechanism (120) is reversed or unloaded and the foil blade (62) can be installed into or removed from the dewatering device (78) in the same manner as that described for FIG. 6. If the cam operated load mechanism (120) is engaged, the cam of the cam design being rotated into operating position and the unload tube (70) is deflated, the foil blade (62) is locked into position on mounting pad (64) in the same manner as that described for FIG. 6.

The locking pin (74) shown in FIGS. 6 and 7 can be eliminated from the loaded clamping assembly (122) of FIG. 8. The cam of the cam design (120) provides a self-locking feature as can be appreciated by those skilled in the art. Once the cam is rotated into position to hold the blade (62) to the pad (64), it is automatically locked into position and the clamping piece (66) cannot accidentally be released. Again, the clamping piece (66) and related equipment are preferably arranged on the upstream side of the blade (62) and pad (64), and the dove-tail connections between the blade (62) and pad (64) are preferably located on the downstream side of the blade (62) and pad (64), for the same reasons described in reference to FIG. 6.

Thus, the loaded clamping assembly (122) of FIG. 8 also provides a foil blade that is easily installed into and removed from a dewatering device and, once mounted, the foil blade is rigidly attached to the dewatering device.

Figure 9:
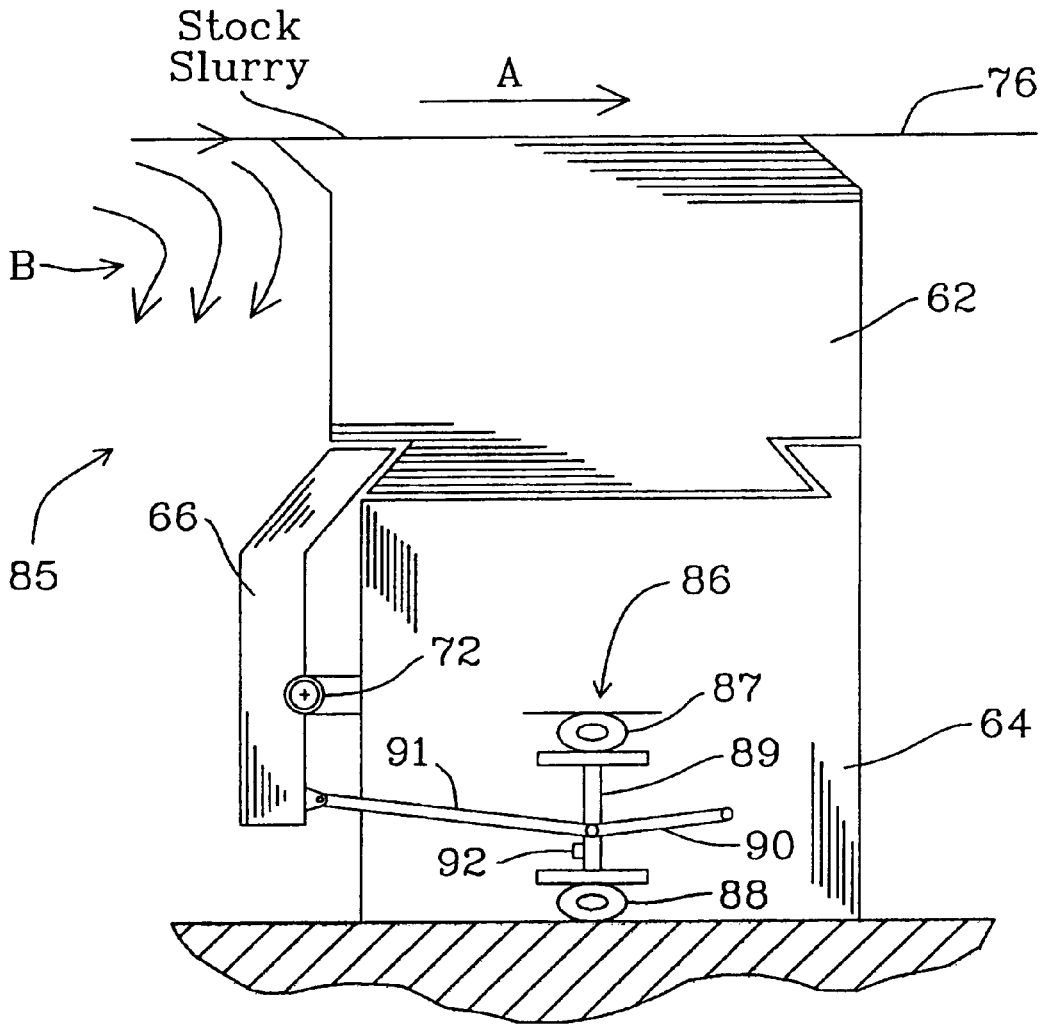
FIG. 9 is a perspective side view of a further embodiment of a pivoting clamp style clamping assembly using an over center pivoting clamp.

FIG. 9 is a perspective side view of a further embodiment of a pivoting clamp style clamping assembly using an over center pivoting clamp. In the loaded clamping assembly (85), the load and unload tubes (68) and (70) of FIG. 6 are replaced with the over center pivoting clamp mechanism (86) shown in FIG. 8. The loaded clamping assembly (85) consists of a foil blade (62), a blade mounting pad (64), a clamping piece (66), a pivot (72) and an over center pivoting clamp mechanism (86). The over center pivoting clamp mechanism (86) consists of the following elements: a load clamp tube (87), an unclamp tube (88), an I-beam support (89), two mechanical arms (90) and (91), and a stop (92).

Like FIGS. 6, 7, and 8, a forming wire or fabric (76) supporting a stock slurry travels over the foil blade (62). Also, like FIGS. 6, 7, and 8, the clamping piece (66) and related equipment are preferably arranged on the upstream side of the blade (62) and pad (64), and the dove-tail connections between the blade (62) and pad (64) are preferably located on the downstream side of the blade (62) and pad (64), for the same reasons described in reference to FIG. 6.

The pivoting clamp style loaded clamping assembly (85) of FIG. 9 is assembled and operates as follows. When connecting the foil blade (62) to the blade mounting pad (64), the unclamp tube (88) is inflated and the load clamp tube (87) is deflated. Due to the arrangement of the mechanical arms (90) and (91) with respect to the I-beam support (89), when the unclamp tube (88) is inflated, the clamping piece (66) pivots around pivot (72) away from the blade (62) and mounting pad (64). In order to lock the blade (62) into place with respect to mounting pad (64), the unclamp tube (88) is deflated and the load clamp tube (87) is inflated. In this way, the clamping piece (66) pivots around the pivot (72) toward the blade (62) and pad (64) and connects with the foil blade in the same manner as that described for FIG. 6. As the load clamp tube (87) is inflated, the mechanical arms (90) and (91) are pushed in the downward direction until the mechanical arms hit the stop (92). The mechanical arms (90) and (91) are arranged such that as the load clamp tube (87) is inflated, the load clamp tube (87) pushes the arms past center which, therefore, locks the mechanical arms in place against the stop (92). Once the mechanical arms are pushed past center, the arms cannot reverse direction until a force is supplied in the upward direction. As a result, the over center pivoting clamp mechanism (86) is a self-locking design. Therefore, the locking pin (74) of FIGS. 6 and 7 has been eliminated in the embodiment shown in FIG. 9. In order to release clamping piece (66), the unclamp tube (88) must be inflated. Even if the load clamp tube (87) was to deflate as a result of a failure, the mechanical arms (90) and (91) will not move until a force is applied against them by way of the unclamp tube (88).

Thus, the loaded clamping assembly (85) of FIG. 9 provides another foil blade design to accomplish the features of the present invention.

Figure 10:
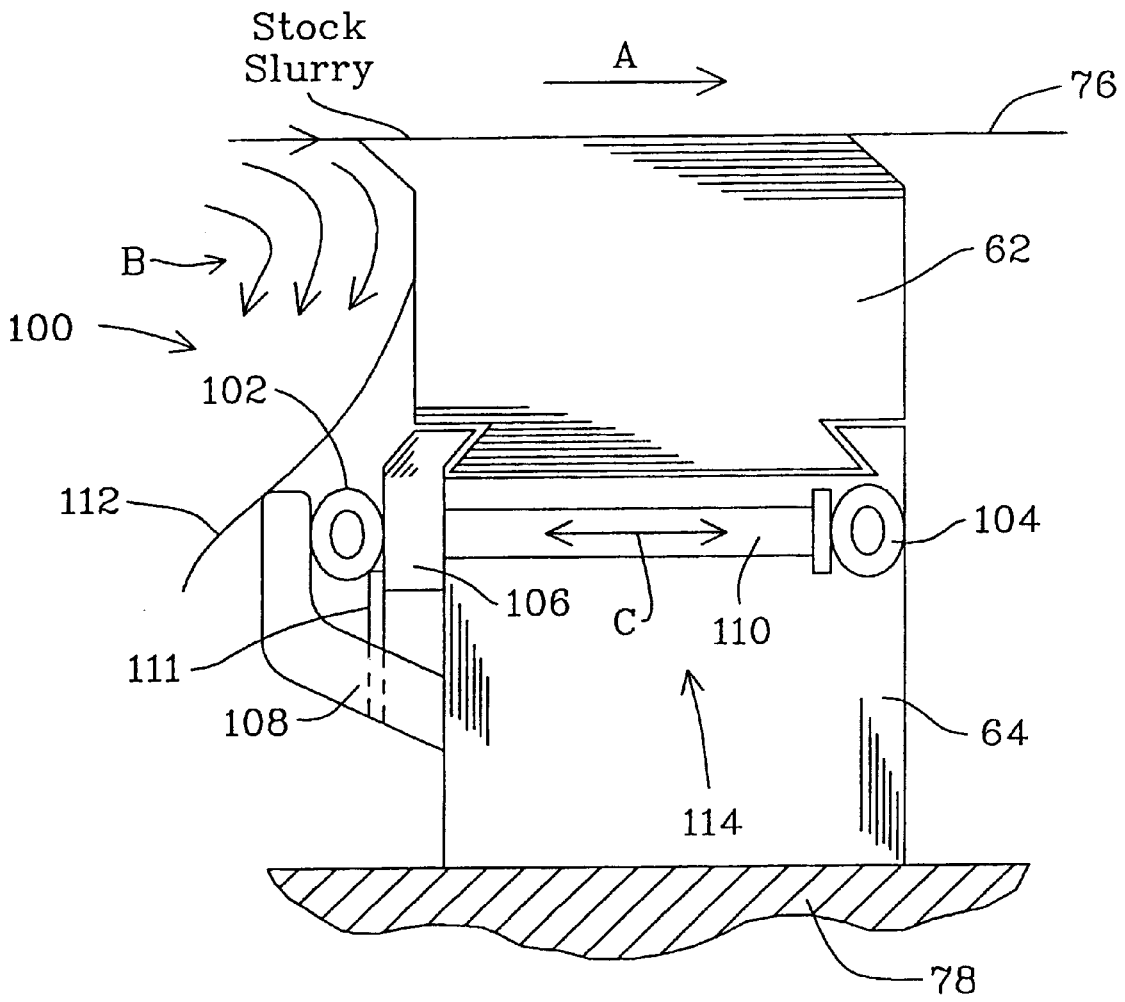
FIG. 10 is a perspective side view of a further embodiment of a loaded clamping assembly according to the present invention referred to as a sliding clamp style clamping assembly described herein and capable of being used in the dewatering devices of FIGS. 1–3.

FIG. 10 is a perspective side view of a further embodiment of a load clamping assembly according to the present invention referred to as a sliding clamp style clamping assembly and is also capable of being used in all of the dewatering devices previously mentioned.

The loaded clamping assembly (100) consists of the following elements: a foil blade (62), a blade mounting pad (64), a load clamp tube (102), an unclamp tube (104), a solid clamp piece (106), a clamp arm (108), a push rod (110), a locking pin (111), and a streamlined shroud (112).

Like FIGS. 6–9, a forming wire or fabric (76) supporting a stock slurry travels over the foil blade (62). Also, like FIGS. 6–9, the clamping piece (66) and related equipment are preferably arranged on the upstream side of the blade (62) and pad (64), and the dove-tail connections between the blade (62) and pad (64) are preferably located on the downstream side of the blade (62) and pad (64), for the same reasons described in reference to FIG. 6.

The sliding clamp style clamping assembly (114) operates on the principle of a sliding arrangement. As the load clamp tube (102) is inflated, the clamp piece (106) rigidly attaches the upstream side of the blade (62) to the upstream side of the mounting pad (64) in the same manner as that described with reference to FIGS. 6–9. The downstream sides of blade (62) and pad (64) are connected via a dove-tail connection as similarly described with reference to FIGS. 6–9. If load tube (102) is deflated and unclamp tube (104) is inflated, the push rod (110) pushes the clamp piece (106) away from the foil blade (62) and the foil blade (62) can be easily removed from the mounting pad (64). The clamp arm (108) is a solid piece rigidly attached to the mounting pad (64), and the load tube (102) inflates or deflates between clamp arm (108) and clamp piece (106). Once the foil blade (62) is rigidly attached to the blade mounting pad (64) by way of the load clamp tube (102), a locking pin (111) is put into position, as shown in FIG. 10, to prevent the clamping piece (106) from becoming disengaged with the blade (62) should the load clamp tube (102) fail and air pressure is lost in the pneumatic load tube. So that the water removed from the stock mixture does not bounce back up into the fabric (76), a streamlined flexible shroud (112) is provided over the clamp arm (108) and related equipment. The flexible shroud (112) can be made of any suitable material. The flexible shroud (112) is connected to the clamp arm (108) and abuts foil blade (62) during operation. In this way, water flows past the blade (62) and pad (64) without interruption into dewatering device (78).

To summarize, the sliding clamp-style clamping assembly of FIG. 10 operates as follows. One side of the dove tail of the blade is held in the fixed mating dove-tail of the support structure. The other side of the dove-tail blade is captivated by the sliding clamp. The sliding clamp is activated by a pneumatic tube that provides the clamping force to secure the dove-tail end and, thus the blade in place. A second pneumatic tube is used to unclamp the blade during a blade change operation. A locking device can prevent accidental unclamping of the dove-tail blade in the event of loss of air pressure in the pneumatic clamp tube.

A loaded clamped foil blade for use in a web forming section of a papermaking machine has been described. Various loaded clamping assemblies for a foil blade have been shown and described to allow easy installation and removal of the foil blade into and from dewatering devices, and to further provide various rigid mounting arrangements, thus preventing the blade from rotating or changing geometry during a papermaking process. While various loaded clamping assemblies have been shown and described herein, various changes may be made without departing from the scope of the present invention. For example, load clamp tubes (87) and (102) shown in FIGS. 9 and 10 respectively, may be replaced with spring loaded clamps similar to the spring loaded clamp (80) described with reference to FIG. 7. As another example, the connection fit between a foil blade and a foil blade mounting pad as described herein, may be configured of many other mechanical connection designs, other than a mechanical dove-tail arrangement, generally known to those skilled in the art.

I claim:

1. A loaded clamping assembly in combination with a foil blade in a dewatering device in a web-forming section of a papermaking machine, said loaded clamping assembly comprising:

a first clamping means for clamping the foil blade to the dewatering device such that the foil blade is rigidly mounted to the dewatering device so that the foil blade is substantially immovable during a papermaking process as a wire or fabric having a stock mixture thereon travels over the foil blade; and second means distinct from said first means for unclamping the foil blade from the dewatering device allowing the foil blade to be easily installed or removed from the dewatering device during a blade changing operation;

wherein said unclamping means comprises an unclamp tube;

a clamping piece;

a load clamp tube, said load clamp tube loading said clamping piece against the foil blade to clamp the foil blade to the dewatering device; A loaded clamping assembly as recited in claim 3, further comprising:

a foil blade mounting pad attached to the dewatering device, said clamping piece being pivotably attached to said foil blade mounting pad, and the foil blade being mounted on said foil blade mounting pad, wherein said foil blade mounting pad having a dove-tail protrusion arranged for receiving one dove-tail end of the foil blade and the other end of the foil blade designed to cooperate with said clamping piece such that the foil blade is clamped or unclamped to the dewatering device depending on how said unclamp tube and said load clamp tube are engaged;

an I-beam support with a top and bottom surface, said load clamp tube positioned on the top surface of said I-beam support, said unclamp tube positioned between the bottom surface of said I-beam support and the dewatering device;

two mechanical arms, both arms being connected to said I-beam support, one arm being connected to said clamping piece, the other arm being connected to the dewatering device; and a stop positioned below one of said mechanical arms such that as said load clamp tube is inflated, said mechanical arms are moved in a downward direction until said mechanical arm located above said stop abuts said stop, said mechanical arms being arranged in such a manner that as said load clamp tube is inflated, said load clamp tube pushes said mechanical arms past center which locks said mechanical arms in position against said stop, preventing said clamping piece from becoming disengaged with the foil blade until desired.

2. A loaded clamping assembly as recited in claim 1, wherein said dove-tail connection between the foil blade and said foil blade mounting pad is located on the downstream side of the foil blade and the foil blade mounting pad in the direction of travel of the wire or fabric so that if said I-beam support or said mechanical arm or said stop fails, forces acting on the foil blade during operation will help prevent the foil blade from becoming completely detached from said foil blade mounting pad, thereby minimizing damage to the wire or other equipment.

3. A loaded clamping assembly as recited in claim 2, wherein water removed from a stock mixture through the wire or fabric travels past the foil blade and said foil blade mounting pad into the dewatering device, wherein said clamping piece is of a curved or streamlined design, wherein said clamping piece is positioned on the upstream side of the foil blade and said foil blade mounting pad so that the exiting water flows into the dewatering device substantially uninhibited.

4. A loaded clamping assembly in combination with a foil blade in a dewatering device in a web-forming section of a papermaking machine, said loaded clamping assembly comprising:

a first clamping means for clamping the foil blade to the dewatering device such that the foil blade is rigidly mounted to the dewatering device so that the foil blade is substantially immovable during a papermaking process as a wire or fabric having a stock mixture thereon travels over the foil blade; and second means distinct from said first means for unclamping the foil blade from the dewatering device allowing the foil blade to be easily installed or removed from the dewatering device during a blade changing operation;

wherein said unclamping means comprises an unclamp tube;

a clamping piece;

a load clamp tube said load clamp tube, loading said clamping piece against the foil blade to clamp the foil blade to the dewatering device;

a foil blade mounting pad attached to the dewatering device, the foil blade being mounted on said foil blade mounting pad;

a movable, horizontally-extending push rod, said clamping piece being attached to said movable push rod, said push rod being located between said clamping piece and said unclamp tube; and a clamp arm, said load clamp tube being positioned between said clamp arm and said clamping piece.

5. A loaded clamping assembly as recited in claim 4, wherein said foil blade mounting pad having a dove-tail protrusion arranged for receiving one dove-tail end of the foil blade and the other end of the foil blade designed to cooperate with said clamping piece such that the foil blade is clamped or unclamped to the dewatering device depending on how said unclamp tube and said load clamp tube are engaged.

6. A loaded clamping assembly as recited in claim 5, further comprising a locking pin to prevent said clamping piece from becoming disengaged with the foil blade should said load clamp tube fail.

7. A loading clamping assembly as recited in claim 6, wherein said dove-tail connection between the foil blade and said foil blade mounting pad is located on the downstream side of the foil blade and said foil blade mounting pad in the direction of travel of the wire or fabric so that if said load clamp tube or said locking pin fails, forces acting on the foil blade during operation will help prevent the foil blade from becoming completely detached from said foil blade mounting pad, thereby minimizing damage to the wire or other equipment.

8. A loading clamp assembly as recited in claim 7, wherein water removed from a stock mixture through the wire or fabric travels past the foil blade and said foil blade mounting pad into the dewatering device, wherein said clamping piece, load clamp tube, and said clamp arm are positioned on the upstream side of the foil blade and said foil blade mounting pad in the direction of travel of the wire or fabric, wherein said loading clamp assembly further comprises:

a flexible, streamlined shroud connected to said clamp arm and abutting the foil blade so that exiting water flows into the dewatering device substantially uninhibited.

9. An apparatus for dewatering stock on a forming fabric to form a paper web, comprising:

a dewatering device;

a foil blade mounting pad, having portions defining one dove-tail protrusion, the mounting pad being mounted to the dewatering device;

a foil blade having a first dove-tail slot and a second opposed dove-tail slot, the foil blade being mounted to the mounting pad, the first dove-tail slot cooperating with the dove-tail protrusion on the foil blade mounting pad to position and hold the foil blade in position with respect to the mounting pad;

a clamping piece pivotally mounted at a pivot to the foil blade mounting pad, the clamping piece having an upper end having a top surface shaped to cooperate with the second dove-tail slot to position and hold the foil blade in position with respect to the mounting pad, and the clamping piece having a lower end, opposite the upper end, the pivot being between the upper end and the lower end;

a first means for clamping the foil blade to the dewatering device such that the foil blade is rigidly mounted to the dewatering device so that the foil blade is substantially immovable during a papermaking process as a wire or fabric having a stock mixture thereon travels over the foil blade, the means being mounted between the pivot and the lower end, and between the clamping piece and the mounting pad, the first means biasing the top surface into locking engagement with the second dove-tail slot; and an inflatable tube for unclamping the foil blade from the dewatering device allowing the foil blade to be easily installed or removed from the dewatering device during a blade changing operation, the inflatable tube being positioned between the clamping piece and the mounting pad and between the pivot and the upper end of the clamping piece, the tube when inflated biasing the top surface out of locking engagement with the second dove-tail slot.

10. The apparatus of claim 9 further comprising a locking pin moveably positionable between the lower end of the clamping piece and the mounting pad to lock the top surface into locking engagement with the second dove-tail slot.

11. The apparatus of claim 9 wherein the first means for clamping is a spring positioned between the clamping piece and the mounting pad and between the pivot and the lower end of the clamping piece, the spring biasing the top surface into locking engagement with the second dove-tail slot.

12. The apparatus of claim 9 wherein the first means for clamping is an inflatable tube positioned between the clamping piece and the mounting pad and between the pivot and the lower end of the clamping piece, the tube when inflated biasing the top surface into locking engagement with the second dove-tail slot.

13. The apparatus of claim 9 wherein the first means for clamping is a cam operated load mechanism positioned between the clamping piece and the mounting pad and between the pivot and the lower end of the clamping piece, the cam when operated biasing the top surface into locking engagement with the second dove-tail slot.

* * * * *